United States Patent [19]

Kröbel et al.

[11] 4,218,055

[45] Aug. 19, 1980

[54] APPARATUS FOR SINGULARIZING STACKED DIELECTRIC RECEPTOR SHEETS FOR LATENT IMAGES

[75] Inventors: Heinz Kröbel, Taufkirchen; Walter Bauer, Munich, both of Fed. Rep. of Germany

[73] Assignee: AGFA-Gevaert, A.G., Leverkusen, Fed. Rep. of Germany

[21] Appl. No.: 956,275

[22] Filed: Oct. 31, 1978

[30] Foreign Application Priority Data

Nov. 7, 1977 [DE] Fed. Rep. of Germany ..... 2749687

[51] Int. Cl.[2] ..... B65H 3/08; B65H 3/56

[52] U.S. Cl. ..... 271/106; 271/11; 271/104

[58] Field of Search ..... 271/11, 99–101, 271/104, 106

[56] References Cited

U.S. PATENT DOCUMENTS

| | | | |
|---|---|---|---|
| 1,554,429 | 9/1925 | Hasselquist | 271/106 |
| 1,861,605 | 6/1932 | Maass | 271/104 |
| 3,635,464 | 1/1972 | Gramlich | 271/104 |

FOREIGN PATENT DOCUMENTS

| | | | |
|---|---|---|---|
| 1147525 | 11/1957 | France | 271/11 |

*Primary Examiner*—Robert W. Saifer
*Attorney, Agent, or Firm*—Peter K. Kontler

[57] ABSTRACT

Apparatus for feeding dielectric receptor sheets and/or sheet-like carriers for receptor sheets to the ionography imaging chamber of a radiographic system from a nearly upright stack of overlapping sheets has a set of suction heads which are mounted on a first lever pivotally mounted on a second lever. The first lever is repeatedly pivoted relative to the second lever to thereby move the suction heads, which attract a portion of the outermost sheet of the stack below the upper edge face of such sheet, along an arcuate path to thereby flex the upper part of the outermost sheet away from the neighboring sheet. The second lever is thereupon pivoted to complete the separation of the outermost sheet from the neighboring sheet and to introduce the upper edge face of the separated outermost sheet into the nip of two advancing rolls which transport the sheet toward or into the interelectrode gap of the imaging chamber. A stripping device is adjustably mounted in the path of movement of outermost sheets with the suction heads relative to the second lever to flex such sheets between the suction heads and the respective upper edge faces whereby the outermost sheets are even more likely to become separated from the neighboring sheets. A pivotable lever is provided to maintain the stripping device in such position that the latter is located at a fixed distance from the paths of upper edge faces of successive outermost sheets, irrespective of changes in the thickness of the stack.

8 Claims, 2 Drawing Figures

APPARATUS FOR SINGULARIZING STACKED DIELECTRIC RECEPTOR SHEETS FOR LATENT IMAGES

CROSS-REFERENCE TO RELATED APPLICATION

The apparatus of the present invention constitutes an improvement over and a further development of apparatus which is disclosed in the commonly owned copending application Ser. No. 866,036 filed Dec. 30, 1977 by Walter BAUER et al.

BACKGROUND OF THE INVENTION

The present invention relates to apparatus for removing sheets from a stack of sheets, and more particularly to improvements in apparatus which can be utilized to singularize stacked dielectric receptor sheets for latent images which are applied thereto in radiographic apparatus. Typical examples of such sheets are polyester sheets which are to be exposed to object-modulated X-rays in the gas-filled interelectrode gap of an ionography imaging chamber. The invention also relates to radiographic apparatus which embody the improved singularizing apparatus.

A radiographic apparatus which images objects onto dielectric sheets is disclosed in commonly owned U.S. Pat. No. 4,061,915 granted Dec. 6, 1977 to Pfeifer et al. Such apparatus can utilize discrete dielectric receptor sheets or receptor sheets which are mounted on flexible carriers consisting of polyethylene. Latent images which are obtained on exposure of receptor sheets to object-modulated X-rays are thereupon converted into visible images by resorting to a liquid developing agent or to toner particles and a fusing device in a manner as disclosed, for example, in the aforementioned U.S. Pat. No. 4,061,915 to Pfeifer et al.

The commonly owned copending application Ser. No. 866,036 of Bauer et at. (whose disclosure is incorporated herein by reference) describes and claims a sheet feeding apparatus with two levers one of which carries a battery of suction heads and is pivotally coupled to the other lever to flex the upper marginal portion of the outermost sheet of a stack away from the next-to-the-outermost sheet before the other lever moves the one lever to a position in which the fully separated outermost sheet is located in the range of advancing rolls for transport of the sheet into the interelectrode gap of the imaging chamber. The just described sheet feeding apparatus insures reliable transfer of discrete sheets from the stack into the range of advancing rolls regardless of the stiffness or lack of stiffness of sheets and without defacing, scratching or otherwise damaging the sensitive surfaces of such commodities.

OBJECTS AND SUMMARY OF THE INVENTION

An object of the invention is to provide a novel and improved sheet feeding and singularizing apparatus which is capable of even more reliably removing one sheet at a time regardless of the stiffness of sheets and regardless of whether or not the sheets are electrostatically charged so that they exhibit a highly pronounced tendency to adhere to each other.

Another object of the invention is to provide the singularizing apparatus with novel and improved means for promoting separation of the outermost sheet of a stack from the next-to-the-outermost sheet.

A further object of the invention is to provide the apparatus with novel and improved means for overcoming the forces which attract neighboring sheets of a stack to each other.

An additional object of the invention is to provide the apparatus with novel and improved means for promoting separation of neighboring sheets during flexing of a portion of the outermost sheet of a stack away from the neighboring portion of the next-to-the-outermost sheet.

Another object of the invention is to provide the apparatus with novel and improved means for insuring a reliable singularizing action irrespective of changes in the thickness of the stack from which the sheets are removed.

An additional object of the invention is to provide an apparatus which, even though particularly suited to separate and singularize relatively stiff sheets which carry or are likely to carry a pronounced electrostatic charge, is also suitable for many other uses in connection with singularization of moderately or highly flexible sheets of any desired size and/or shape.

An ancillary object of the invention is to provide the apparatus with novel and improved means for imparting predictable recurrent movements to various mobile components including those which initiate and complete the separation of successive outermost sheets of a stack from the next-to-the-outermost sheets.

The invention is embodied in an apparatus for singularizing and transporting successive outermost sheets of a stack of overlapping sheets having edge faces, particularly for feeding discrete dielectric receptor sheets for latent images to the ionography imaging chamber of a radiographic system. The apparatus comprises a support which may include one or more upright plate-like frame members, a first transfer member (e.g., a lever pivotable about a fixed horizontal axis) mounted on the support and movable between first and second end positions in which the transfer member is respectively nearer to and more distant from the outermost sheet of the stack which is placed into a tray or an analogous receptacle on or in the support, a second transfer member (e.g., a second pivotable lever), means for turnably mounting the second transfer member on the first transfer member for movement between a first position and a second position, at least one suction head or an analogous sheet attracting member mounted on the second transfer member and being adjacent to and attracting that portion of the outermost sheet of the stack which is spaced apart from the respective edge face (e.g., the upper edge face) in the first position of the second transfer member, means for moving the second transfer member between the first and second positions whereby the attracting member moves along an arcuate path away from the stack in response to movement of the second transfer member to the second position and the aforementioned portion of the outermost sheet is flexed in a direction away from the neighboring sheet of the stack, means for moving the first transfer member with the second tranfer member from the first to the second end position while the second transfer member is out of the first position whereby the first transfer member completes the separation of the outermost sheet from the neighboring sheet of the stack, and a preferably rod-shaped separating or stripping device which is located in the path of movement of successive outermost sheets between the edge faces and the attracted portions of the respective sheets to flex such sheets while the second transfer member moves relative to the first transfer member and to thus promote separation of the outermost sheet from the neighboring sheet of the stack.

The apparatus preferably further comprises means for changing the position of the separating device with respect to the stack so as to maintain the separating device at a fixed distance from the edge faces of successive outermost sheets of the stack. The edge faces of the outermost and innermost sheets of the stack move along discrete first and second arcuate paths in response to movement of the second transfer member from the first to the second position, and the position changing means for the separating device preferably comprises a lever one arm of which supports the separating device and which is pivotable about an axis located in a predetermined plane, namely, in a plane which is disposed midway between two spaced apart points of the outermost sheet of the stack and extends at right angles to a line connecting such points. One of the aforementioned points is located at a predetermined distance from the first arcuate path (of the edge face of the outermost sheet of a full stack) and the other point is located at the same distance from the second arcuate path (of the edge face of the innermost sheet of such stack). This insures that the separating device invariably engages each of a series of successive outermost sheets at the aforementioned fixed distance from the edge face of the respective sheet, preferably closer to the edge face than to the attracting device.

The apparatus preferably further comprises cam means provided on the first transfer member and serving to engage the separating device during the last stage of movement of the first transfer member to its first end position as well as in the first end position of the first transfer member. Still further, the apparatus may comprise stop means for the position changing lever and a spring or other suitable means for yieldably biasing the lever against the stop means. The stop means is mounted on or in the support in such position that it is engaged by the lever in that position of the separating device in which the latter is located at the aforementioned fixed distance form the edge face of the outermost sheet of a full stack of sheets. The cam means has a cam face which engages the separating device and pivots the lever away from the stop means on movement of the first transfer member to its first end position subsequent to removal of at least some outermost sheets from the stack.

Still further, the apparatus may be provided with means for repeatedly moving the second transfer member between the first and second positions in the first end position of the first transfer member prior to movement of the first transfer member to the second end position. This further reduces the likelihood of adherence of the outermost sheet to the neighboring sheet of the stack because the separating device flexes the outermost sheet during each and every movement of the second transfer member with respect to the first transfer member. The means for repeatedly moving the second transfer member relative to the first transfer member may comprise a reversible prime mover, e.g., an electric motor which further serves to pivot the first transfer member between the first and second end positions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
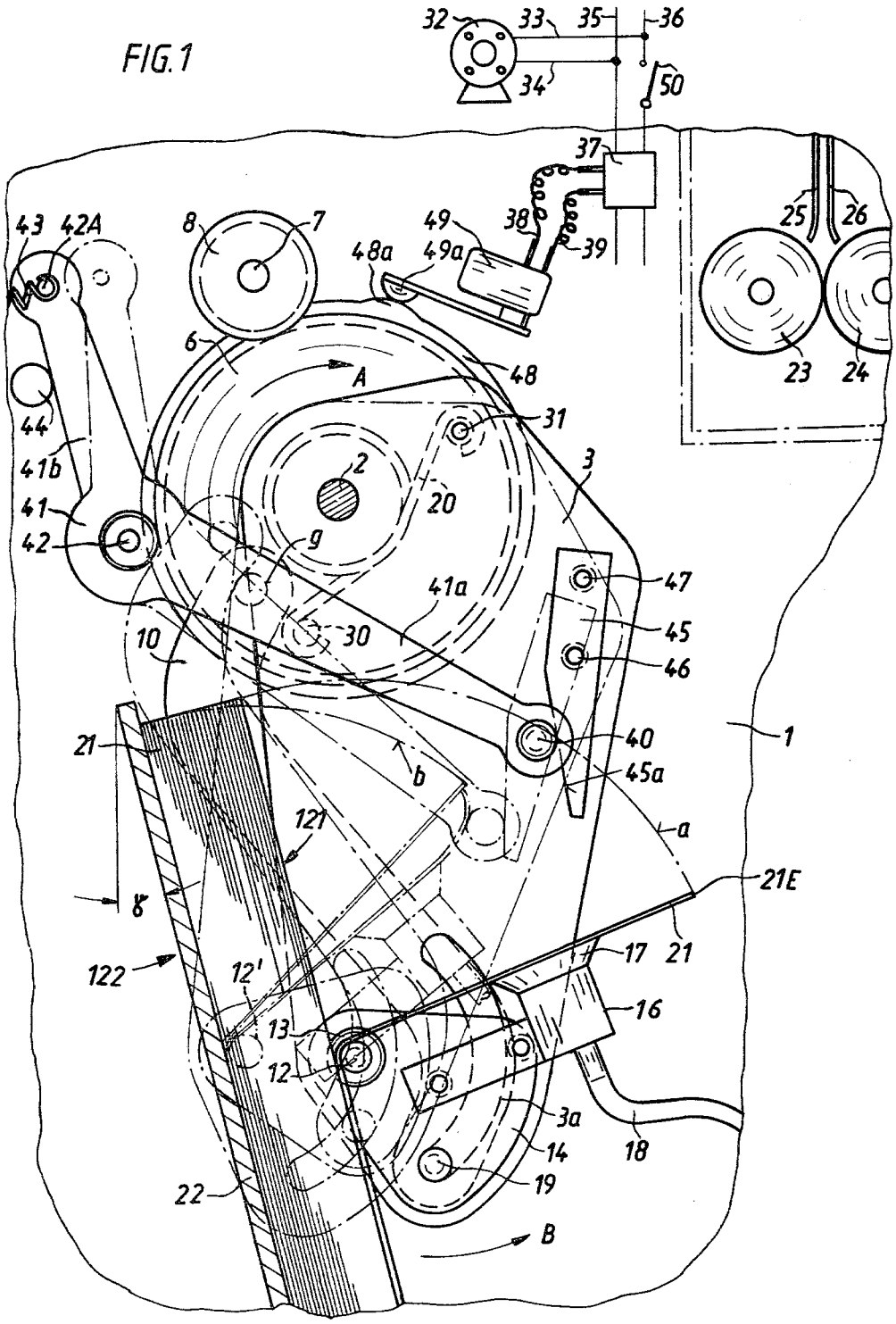
FIG. 1 is a somewhat schematic fragmentary vertical sectional view of a singularizing apparatus which embodies the invention and delivers successive dielectric receptor sheets into the nip of two advancing rolls.

FIG. 1 shows a singularizing apparatus which includes many components similar to or identical with certain components of the apparatus disclosed in the copending application Ser. No. 866,036 of Bauer et al. Such components include a plate-like frame member or support 1 for one end portion of a horizontal shaft 2 which constitutes a support for at least one but preferably two first transfer members in the form of levers 3 (only one shown) pivotable between first and second end positions. The illustrated lever 3 is pivotable between a first end position in which it is closely adjacent to the outermost sheet 21 of a stack 121 of sheets in a slightly inclined tray 122 including a sloping side wall 22 and a bottom wall (not shown) which latter carries the major part of the weight of the stack 121 to thus insure that the pressure between neighboring sheets 21 is as low as possible. The angle gamma between a vertical plane and the wall 22 of the tray 122 is approximately 30 degrees; this insures that the outermost sheet 21 of the stack 121 leans against the adjacent sheet but with a negligible force. The sheets 21 are assumed to constitute dielectric receptor sheets made of polyester or another suitable material and serving to receive latent images during exposure to object-modulated X-rays in the gas-filled interelectrode gap of an ionography imaging chamber, e.g., a chamber of the type described in the aforementioned U.S. Pat. No. 4,061,915 to Pfeifer et al.

The lever 3 is biased to the end position of FIG. 1 by a torsion spring 20 which is coiled around a portion of the shaft 2 in a manner as disclosed in the copending application Ser. No. 866,036 to Bauer et al. A hold-down device 12 (e.g., a horizontal pin) which is secured to the lever 3 bears against the outer side of the outermost sheet 21 at a level below the upper edge portion of such sheet and below one or more suction heads 17 which are mounted on a holder or traverse 16 secured to one or two second transfer levers 14, preferably two transfer levers each of which is adjacent to a discrete lever 3. The torsion spring 20 has a first leg which engages a post 31 of a driving gear 6 and a second leg which engages a post 30 of the lever 3 to bias the latter in a clockwise direction, as viewed in the drawing.

In the embodiment which is shown in FIG. 1, the hold-down device 12 defines a pivot axis for the corresponding transfer member 14 which, as stated above, supports and moves the holder 16 for the suction head or heads 17. The reference character 13 denotes a bearing sleeve which surrounds a portion of the hold-down device 12 and is surrounded by the lever 14. Each suction head 17 is connected with the intake of a suction pump or the like (not shown) by a flexible conduit 18. The battery of suction heads 17 can be replaced with a single elongated suction head which can attract the upper marginal portion of the outermost sheet 21 of the stack at a level above the hold-down device 12 so that, when the lever 14 is pivoted clockwise to the position which is shown by solid lines, the upper marginal portion of the outermost sheet 21 is flexed about the device 12 to move away from the adjacent portion of the next-to-the-outermost sheet of the stack 121.

The lever 14 has a pin-shaped follower 19 which is coupled to the lower end portion of a motion transmitting link 10 and is slidable in an arcuate guide groove 3*a* of the lever 3. The length of the groove 3*a* determines the extent of pivotal movement of the lever 14 relative to the lever 3. The upper end portion of the link 10 is articulately connected to an eccentric pin 9 of the driving gear 6. The latter meshes with a second gear 8 which is mounted on a horizontal shaft 7 driven by a reversible prime mover 32, preferably an electric motor which is connected to a source of electrical energy (leads 35 and 36) by conductor means 33, 34. The circuit of the motor 32 can be opened by a switch 50. The shaft 7 is mounted in the frame members 1 in parallelism with the shaft 2. When the gear 8 is driven counterclockwise, the driving gear 6 is caused to rotate clockwise (arrow A) to move the lever 3 to the end position which is shown in the drawing. The transmission of torque from the gear 6 to the lever 3 takes place via the torsion spring 20. The follower 19 of the lever 14 is then located in the lower end portion of the guide slot 3*a* so that the open sides of the suction heads 17 are remote from the stack 121. The follower 19 is held in the lower end portion of the slot 3*a* by the spring 20. When the hold-down device 12 reaches and bears against the outer side of the outermost sheet 21 of the stack 121, the gear 6 (which continues to turn in the direction indicated by arrow A) moves relative to the lever 3 and against the opposition of the spring 20 whereby the link 10 pivots the lever 14 counterclockwise (as indicated by the arrow B) to move the open sides of the suction heads 17 against the outer side of the outermost sheet 21 at a level above the hold-down device 12. The direction of rotation of the gear 8 is thereupon reversed so that the gear 6 rotates counterclockwise and causes the link 10 to move the lever 14 back to the illustrated position whereby the suction heads 17 flex the upper portion of the outermost sheet 21 about the hold-down device 12, and such upper portion of the outermost sheet normally moves away from the adjacent portion of the next-to-the-outermost sheet 21 of the stack 121. Pivotal movement of the lever 14 in a clockwise direction (to the illustrated position) is terminated when the follower 19 enters the lower end portion of the guide slot 3*a*. As the motor 32 continues to rotate the gear 8 in a clockwise direction, the gear 6 continues to turn counterclockwise and pivots the lever 3 via the spring 20 so that the lever 3 transfers the lever 14 with suction heads 17 and the fully or nearly fully separated outermost sheet 21 away from the stack 121 so that the uppermost marginal portion of the separated outermost sheet 21 enters the nip of driven advancing rolls 23, 24 which introduce the sheet into a channel between two guide members 25 and 26. The sheet is caused to enter the interelectrode gap of the ionography imaging chamber in a manner as disclosed and shown in the application Ser. No. 866,036 of Bauer et al.

In order to insure that the next-to-the-outermost sheet 21 of the stack 121 will not adhere to the sheet 21 which is attracted by the suction heads 17, the apparatus further comprises a stripping or separating device 40 which resembles a rod and flexes the outermost sheet 21 at a level above the suction heads 17 while the suction heads 17 pivot with the lever 14 toward the positions which are shown in the drawing. The stripping device 40 engages the outer side of the outermost sheet 21 closer to the upper edge face 21E than to the suction head 17 and thus promotes (if necessary) separation between such uppermost portion and the uppermost portion of the neighboring (next to-the-outermost) sheet 21. As soon as the edge face 21E advances beyond the stripping device 40, it automatically returns to the illustrated position (namely, to the position in which the entire or the major portion of the flexed part of the outermost sheet 21 is located in a single plane which is substantially tangential to the hold-down device 12 and is adjacent to the open sides of the suction heads 17). The just described movements of the upper portion of the sheet 21, which are induced by the stripping device 40, cause at least some relative movement between such upper portion and the upper portion of the adjacent sheet 21 whereby the latter becomes separated from the outermost sheet 21 and returns to a position of full or nearly full parallelism with the side wall 22 of the tray 122. It is to be understood that, in many or most instances, the action of the stripping device 40 upon the upper portion of the outermost sheet 21 constitutes a precautionary measure since the upper portion of the outermost sheet 21 normally becomes separated from the adjacent portion of the next-to-the-outermost sheet 21 as a result of flexing of the upper portion of the outermost sheet 21 by the suction heads 17 in response to clockwise pivoting of the lever 14 with respect to the lever 3.

The position of the stripping device 40 with respect to other parts is selected in such a way that the device 40 cannot interfere with attraction between the suction heads 17 and the upper portion of the outermost sheet 21. For example, it could happen that the outermost sheet 21 would become separated from the suction heads 17 if the stripping device 40 were placed too close to the holder 16, i.e., too close to the open sides of the suction heads 17. Therefore, it is desirable to maintain the stripping device 40 at an optimum distance from the path of movement of the suction heads 17 as well as at an optimum distance from the upper edge face 21E of the outermost sheet 21. It has been found that separating action of the stripping device 40 is especially satisfactory if this device is maintained at a fixed distance from the upper edge faces 21E of successive outermost sheets 21. This necessitates a continuous or at least intermittent adjustment of the position of the stripping device 40 since the lower end position of the lever 3 changes as the thickness of the stack 121 in the tray 122 decreases.

As shown in the drawing by the arcuate phantom line a, the upper edge face 21E of the outermost sheet 21 travels along a relatively long arcuate path when the tray 122 contains and supports a relatively thick stack 121. The length of the arcuate path is reduced (see the phantom line b) when the thickness of the stack 121 decreases. This will be readily appreciated since the lower end portion of the lever 3 travels toward the side wall 22 as the thickness of the stack 121 decreases. Moreover, the hold-down device 12 also travels in response to changes in the position of the lower end portion of the lever 3. The position of the hold-down device 12 during removal of the last sheet or sheets of the stack 121 is shown at 12'. It will be noted that the length of the flexed upper portions of successive sheets 21 decreases in response to decreasing thickness of the stack 121.

In order to compensate for such wandering of the hold-down device 12 in response to changes in the lower end position of the lever 3, the apparatus comprises means for automatically changing the position of the stripping device 40 in response to decreasing thickness of the stack 121. The changing or adjusting means comprises a bell crank lever 41 which is pivotable about a fixed pin 42 mounted in the frame members 1 and extending in parallelism with the shafts 2 and 7. The longer arm 41*a* of the lever 41 carries the stripping device 40 and the shorter arm 41*b* of the lever 41 carries a post 42A for one end of a spring 43 which biases the lever 41 counterclockwise, as viewed in the drawing, whereby the stripping device 40 or a portion of the arm 41*a* bears against a suitably inclined cam face 45*a* provided on a plate cam 45 secured to the lever 3 by screws 46, 47 or other suitable fasteners. The spring 43 tends to maintain the shorter arm 41*b* of the lever 41 in abutment with a stop 44 which is secured to the frame member 1. The arm 41*b* abuts against the stop 44 when the tray 122 supports a full stack 121 of sheets 21. The mounting of the cam 45 on the lever 3 and/or the configuration of the cam face 45*a* can be selected empirically or by relatively simple calculation in such a way that the stripping device 40 is maintained at an optimum distance from the edge faces 21E of successive sheets 21 regardless of the thickness of the stack 121.

The driving gear 6 transmits torque to a disk-shaped cam 48 which has a protuberance or lobe 48*a* and is tracked by the movable contact 49*a* of a microswitch 49. The microswitch 49 is connected with a control unit 37 by conductor means 38 and 39. The control unit 37 serves to cause the motor 32 to repeatedly move the suction heads 17 between the illustrated positions and the positions in which the suction heads 17 are immediately adjacent to the stack 121 to thereby further reduce the likelihood of removal of two or more sheets 21 at a time. The arrangement is such that, whenever the operator closes the switch 50 in order to initiate the transfer of a sheet 21 from the tray 122 into the nip of the advancing rolls 23 and 24, the lever 14 is repeatedly pivoted with respect to the lever 3 before the lever 3 moves from the illustrated end position to that end position in which the upper marginal portion of the outermost sheet 21 enters the nip of the rolls 23 and 24. The direction of rotation of the gear 6 is reversed when the movable portion 49*a* of the switch 49 engages and is deformed or displaced by the lobe 48*a* of the cam 48. It has been found that such repeated pivoting of the lever 14 before the lever 3 is pivoted between its end positions further reduces the likelihood of entrainment of two or more sheets into the nip of the advancing rolls 23, 24.

The control unit 37 comprises two limit switches and a mechanical or electronic counter which determines the number of movements of the lever 14 relative to the lever 3 before the latter is pivoted to move the edge face 21E of the outermost sheet 21 into the nip of the advancing rolls 23 and 24. The counter is preferably adjustable so that the attendant can select the number of pivotal movements of the lever 14 relative to the lever 3 before the outermost sheet 21 is fully removed from the next-to-the-outermost sheet 21 by pivoting the lever 3 in a counterclockwise direction, as viewed in the drawing. The lever 14 remains in the end position which is shown in the drawing while the motor 32 causes the lever 3 to pivot counterclockwise. The stripping device 40 flexes the upper portion of the outermost sheet 21 in opposite directions while the lever 14 pivots back and forth relative to the lever 3. This further reduces the likelihood of adherence of the next-to-the-outermost sheet 21 to the outermost sheet 21 before the latter is introduced into the imaging chamber.

The stripping device 40 could be mounted directly on the lever 14 and/or 3 so that it would engage the outermost sheet 21 at a fixed distance from the suction heads 17. Such construction is quite satisfactory, especially when the thickness of a fresh stack 121 is not pronounced. It has been found that the mounting of the stripping device 40 in such a way that it is located at a fixed distance from the edge face 21E of an oncoming outermost sheet 21 regardless of the thickness of the stack 121 is even more satisfactory because the extent to which successive sheets 21 are flexed during travel past the stripping device 40 is always the same even though the distance between the device 40 and the suction heads 17 varies in response to decreasing thickness of the stack.

Figure 2:
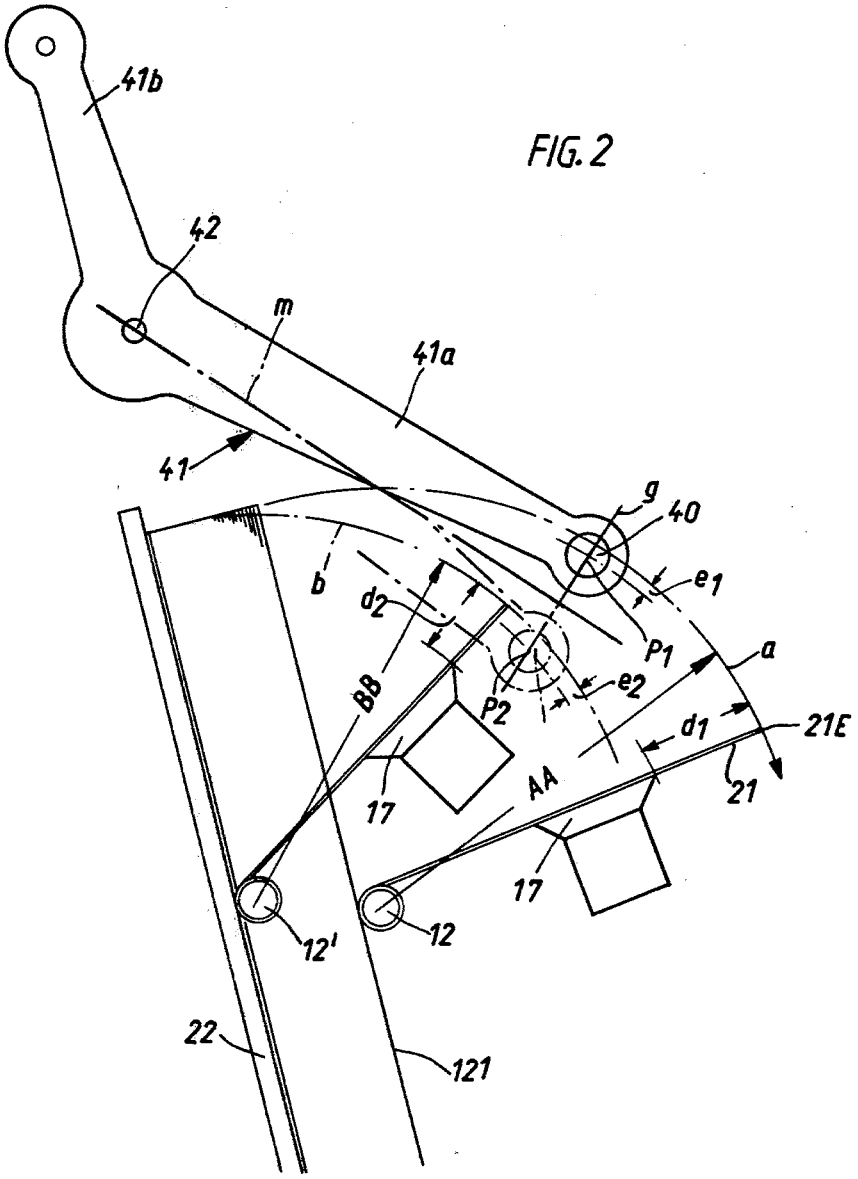
FIG. 2 illustrates a detail in the apparatus of FIG. 1.

The position of the axis of the pivot pin 42 for the bell crank lever 41 is preferably selected in such a way that the axis is located in a plane m (denoted in FIG. 2 by a phantom line) making an angle of 90 degrees with a line g. The line g connects two points in the path of movement of the outermost sheet 21 of a full stack 121 in response to pivoting of the lever 14 relative to the lever 3. The two points can be located at the center of the stripping device 40. FIG. 2 shows the points P1 and P2 which are connected by the line g. The distance between the point P1 and the path a equals e1, and the distance between the point P2 and the path b equals e2 ($e1=e2$). The reference character AA denotes the radius of curvature of the path a, and the reference character BB denotes the (smaller) radius of curvature of the path b. The character d1 denotes the distance between the suction heads 17 and the edge face 21E of the outermost sheet 21, and the character d2 denotes the (shorter) distance between the suction heads 17 and the upper edge face of the innermost sheet 21 of the stack 121 when such innermost sheet 21 is attracted by the suction heads 17. Were the stripping device 40 pivotable about the hold-down device 12, the distance between the stripping device 40 and the upper edge faces of successively removed sheets 21 would vary (decrease) at the same rate at which the distance between the suction heads 17 and such upper edge faces decreases from d1 to d2. The selection of the pivot (axis of pin 42) for the lever 41 in a manner as described above insures that the distance between the device 40 and the upper edge face of each sheet 21 remains unchanged (it equals $e1=e2$). The plane m is normal to the line g midway between the points P1 and P2. The illustrated line g includes the axis of the hold-down device 12 in the solid-line position. The point P1 is a point on the outermost sheet 21 and the point P2 is also a point on the outermost sheet 21 of the stack 121. The distance between the point P1 and the path a is the same as the distance between the point P2 and the path b.

The provision of the cam 45 renders it possible to select an optimum position of the stripping device 40 for each thickness of the stack 121. The cam 45 establishes an operative connection between the levers 3 and 41 and insures that the lever 41 need not share all movements of the lever 3, i.e., the lever 41 cannot collide with the advancing rolls 23, 24.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for singularizing and transporting successive outermost sheets of a stack of overlapping sheets having edge faces, particularly for feeding discrete sheets to the ionography imaging chamber of a radiographic system, comprising a support; a first transfer member mounted in said support and movable between first and second end positions in which said member is respectively nearer to and more distant from the outermost sheet of the stack; a second transfer member; means for turnably mounting said second member on said first member for movement between a first position and a second position; at least one sheet attracting member mounted on said second member and being adjacent to and attracting, in the first position of said first member, that portion of the outermost sheet of the stack which is spaced apart from the respective edge face, said attracting member moving along an arcuate path away from the stack in response to movement of said second member to said second position whereby said portion of the outermost sheet is flexed in a direction away from the neighboring sheet; means for moving said second member between said first and second positions; means for moving said first member, together with said second member, from said first to said second end position while said second member is out of said first position, whereby said first member completes separation of the outermost sheet from the neighboring sheet; a separating device located in the path of movement of successive outermost sheets between said portions and said edge faces of the respective sheets to flex such sheets while said second member moves relative to said first member and to thus promote the separation of outermost sheets from the neighboring sheets of the stack; and means for changing the position of said separating device with respect to the stack so as to maintain said device at a fixed distance from the edge faces of successive outermost sheets at least for the edge faces of the outermost and innermost sheets of the stack which move along discrete first and second arcuate paths in response to movement of said second member from the first to the second position thereof, said position changing means including a lever supporting said device and pivotable about an axis located in a plane disposed midway between two spaced apart points of the outermost sheet of the stack and normal to a line connecting said points, one of said points being located at a predetermined distance from said first arcuate path and the other of said points being located at the same distance from said second arcuate path.

2. The apparatus of claim 1, further comprising cam means provided on said first transfer member and engaging said separating device during the last stage of movement of said first member to and in said first end position.

3. The apparatus of claim 2, further comprising stop means for said lever and means for biasing said lever against said stop means, said stop means being mounted on said support in such position that it is engaged by said lever in that position of said separating device in which the latter is located at said fixed distance from the edge face of the outermost sheet of a full stack, said cam means having a face which engages said separating device and pivots the lever away from said stop means on movement of said first member to said first end position subsequent to removal of successive outermost sheets from the stack.

4. The apparatus of claim 1, further comprising means for repeatedly moving said second member between said first and second positions in the first end position of said first member prior to movement of said first member to said second end position.

5. The apparatus of claim 4, wherein said means for repeatedly moving said second member comprises a reversible prime mover.

6. The apparatus of claim 1, wherein said edge faces are the upper edge faces of sheets forming said stack, and further comprising an inclined receptacle for the stack, the position of said receptacle with respect to the path of movement of said first member being such that the distance between said attracting member and the edge faces of successively removed sheets decreases in response to decreasing thickness of the stack.

7. The apparatus of claim 1, wherein said separating device is nearer to the edge faces of successive outermost sheets than to the path of said attracting member.

8. The apparatus of claim 1, wherein said separating device includes a rod-shaped portion.

* * * * *